United States Patent [19]

Gogniat

[11] 4,437,770

[45] Mar. 20, 1984

[54] TIMEPIECE

[75] Inventor: Paul Gogniat, Bienne, Switzerland

[73] Assignee: Montres Rado S.A., Longeau, Switzerland

[21] Appl. No.: 445,731

[22] Filed: Nov. 30, 1982

[30] Foreign Application Priority Data

Dec. 2, 1981 [CH] Switzerland ..... 7705/81

[51] Int. Cl.[3] ..... G04B 37/00; G04B 19/06; G04B 37/08

[52] U.S. Cl. ..... 368/294; 368/88; 368/232; 368/276; 368/296; 73/431

[58] Field of Search ..... 368/88, 232, 276, 286, 368/287, 291, 292, 294, 295, 296; 73/431

[56] References Cited

U.S. PATENT DOCUMENTS 2,344,422 3/1944 Sickinger ..... 368/294 X
3,996,881 12/1976 Schneider ..... 73/431 X
4,086,754 5/1978 Yonekawa et al. ..... 368/296
4,241,442 12/1980 Grohoski ..... 368/296 X

FOREIGN PATENT DOCUMENTS 908125 12/1944 France ..... 368/296

*Primary Examiner*—J. V. Truhe
*Assistant Examiner*—Terry Flower
*Attorney, Agent, or Firm*—Peter L. Berger

[57] ABSTRACT

A timepiece (1) contains a movement (2), topped by a dial (3) and housed in a casing (4) of a watch case. A crystal (5) is located over at least a portion of its periphery against the upper edge (6) of the casing. The edge (6) has a surface inclined (7) toward the inside of the case and defines with the opposite surface of the periphery of the crystal and with the outer edge of a riser (8) placed on the circumference of the dial (3) a housing in which a gasket (9) is deformably held.

7 Claims, 1 Drawing Figure

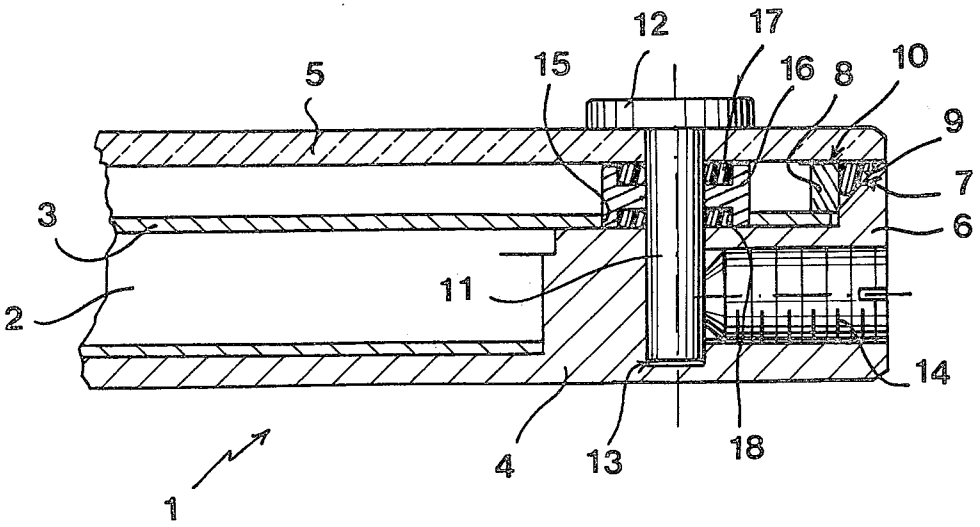
1
2
3
4
5
6
7
8
9
10
11
12
13
14
15
16
17
18

TIMEPIECE

This invention concerns timepieces and it relates more specifically to elegant pieces in which the removable crystal is borne, at least over a portion of its periphery, directly on the upper edge of the watch casing.

In this type of design, it has not been possible to use dials sweeping a very wide area, which extends up to the edge of the casing because of the size of the housings that have to be provided for a gasket. To conceal that gasket it is necessary to resort to metallized zones of corresponding width on the lower face of the crystal, which thicken the line of the timepiece.

The invention, which is intended to solve that problem, will be understood by the following specification, given with reference to the attached drawing, which represents, in partial section, one particular embodiment thereof.

The timepiece, generally marked 1 on the drawing contains a movement 2 topped by a dial 3 and housed in the lower part 4 of a watch case. A crystal 5 is applied against the upper edge 6 of the lower part 4. That upper edge 6 has a surface 7 inclined toward the inside of the case. A triangular section is formed between surface 7, the surface opposite the crystal 5 and the outer edge of a riser 8 placed on the periphery of the dial 3.

To conceal the gasket 9, a metallized layer 10 provided on the bottom surface of the crystal extends beyond the riser 8. The width of the layer 10 can be very slight, in the order of 1.5 mm or less. That width will be all the smaller as the inclined surface 7 extends over a greater width of the edge 6. In the embodiment of the drawing, it covers approximately that whole width, its slope being approximately 45°.

In the drawing, a particular arrangement for keeping the crystal 5 against the lower part 4 has also been represented. That arrangement includes connecting elements 11, the first end of which is provided with a head 12 which rests on the crystal 5 assuring the retention of the latter. The other end of the connecting elements 11 is detachably fasteneed in passages 13 of the casing 4, e.g., by means of set screws 14. According to one characteristic of the design which allows the use of large diameter dials, the elements 11 also cross appropriate passages 15 in the dial 3. A tubular part 16 retains gaskets 17 and 18 to surround the body of elements 11.

Although the invention has been described in relation to one of its embodiments, it is not limited thereto, but rather lends itself to numerous modifications and variations which will be evident to one of skill in the art.

In particular, the shape of the housing for the gasket 9 may be other than triangular, especially if the inclined surface 7 does not extend over the whole width of the edge 6, or if it has several different inclinations. Likewise, the housing, as defined by the crystal 5, the upper edge 6 of the lower part 4 and the riser 8 does not have to extend over the entire periphery of the crystal, but may extend on two opposite sides only of a rectangular casing, the other two sides being occupied by slides or claws fastening the crystal. It is also clear that the connecting element 11 could easily be replaced by any suitable assembly part.

What is claimed is:

1. A timepiece comprising a workpiece movement controlling a dial, the movement being housing in a lower part of a watch case and crystal applied over at least a portion of its periphery against an upper edge of the lower part, wherein a housing is provided below the periphery of said crystal, said housing being formed by said upper edge having a surface inclined toward the inside of the case and the surface on the periphery of the crystal opposite said inclined surface, and a gasket placed and deformably held in said housing below said periphery of said crystal.

2. A timepiece according to claim 1, further comprising a riser placed on said dial and located between said dial and said crystal, said housing being further defined by the outside edge of said riser facing said inclined surface.

3. A timepiece according to claims 1 or 2, wherein said housing comprises a triangular section.

4. A timepiece according to claims 1 or 2, wherein said inclined surface extends approximately over the entire width of said upper edge.

5. A timepiece according to claims 1 or 2, wherein said inclined surface slopes approximately 45° in relation to the plane of the crystal.

6. A timepiece according to claim 2, wherein the lower surface of the crystal opposite the gasket and riser is provided with a metallized masking layer over a width of no greater than approximately 1.5 mm.

7. A timepiece according to claims 1, 2 or 6, further comprising a connecting member retaining the crystal on the lower part, the connecting member comprising a head end resting on said crystal and a body connected to said head end, said body passing through said dial to be detachably fastened on the lower part.

* * * * *